US010626549B2

(12) United States Patent
Inatomi et al.

(10) Patent No.: US 10,626,549 B2
(45) Date of Patent: Apr. 21, 2020

(54) RESIN-COATED NON-WOVEN FABRIC

(71) Applicants: Toyobo Co., Ltd., Osaka (JP); TOYO CLOTH CO., LTD., Osaka (JP)

(72) Inventors: Shinichiro Inatomi, Osaka (JP); Hiroyasu Sakaguchi, Osaka (JP); Atsushi Daimon, Osaka (JP)

(73) Assignees: TOYOBO CO., LTD., Osaka (JP); TOYCO CLOTH CO., LTD., Osaka (JP)

( * ) Notice: Subject to any disclaimer, the term of this patent is extended or adjusted under 35 U.S.C. 154(b) by 422 days.

(21) Appl. No.: 14/777,812

(22) PCT Filed: Sep. 2, 2013

(86) PCT No.: PCT/JP2013/073541
§ 371 (c)(1),
(2) Date: Sep. 17, 2015

(87) PCT Pub. No.: WO2014/147864
PCT Pub. Date: Sep. 25, 2014

(65) Prior Publication Data

US 2016/0258111 A1 Sep. 8, 2016

(30) Foreign Application Priority Data

Mar. 19, 2013 (JP) ..... 2013-056800

(51) Int. Cl.
*D06N 3/04* (2006.01)
*D06N 3/00* (2006.01)
(Continued)

(52) U.S. Cl.
CPC ..... *D06N 3/042* (2013.01); *D04H 3/011* (2013.01); *D04H 3/14* (2013.01); *D06N 3/0011* (2013.01);
(Continued)

(58) Field of Classification Search
CPC .. D06N 7/0002; D06N 3/0011; D06N 3/0036; D06N 3/0077; D06N 3/06;
(Continued)

(56) References Cited

U.S. PATENT DOCUMENTS

2007/0100049 A1* 5/2007 Ishizuka ..... C08K 5/521 524/417
2009/0117806 A1* 5/2009 Kaneda ..... B32B 5/06 442/393

FOREIGN PATENT DOCUMENTS

JP S62062991 3/1987
JP S63098441 4/1988
(Continued)

OTHER PUBLICATIONS

Machine Translation of JP H11-241277. 1999.*
Machine Translation of JP 2013-032601. 2013.*
Japanese Patent Office, official communication in Japanese Patent Application No. JP 2013056800 dated Jan. 21, 2014 with English translation.
(Continued)

*Primary Examiner* — Brian Handville
(74) *Attorney, Agent, or Firm* — Fish & Richardson P.C.

(57) ABSTRACT

A resin-coated non-woven fabric is provide that may be welded through a high-frequency welder and may be remedied in hardness, and further may have a clear embossed pattern. A resin-coated non-woven fabric of the present invention comprises: a filament non-woven fabric that is of a thermocompression-bondable type, is made of a polyethylene terephthalate and has a weight of 50 to 150 g/m$^2$; and a resin coat layer positioned over one surface of the filament non-woven fabric and having a coating amount of 40 to 150 g/m$^2$ after dried; wherein the resin coat layer contains 10 to 45% by mass of a vinyl chloride unit and 30 to 55% by mass of a (meth)acrylic acid ester unit, and further a surface of the resin coat layer has an embossed pattern.

6 Claims, 2 Drawing Sheets

(51) Int. Cl.

| | |
|---|---|
| ***D04H 3/011*** | (2012.01) |
| ***D04H 3/14*** | (2012.01) |
| ***D06N 3/06*** | (2006.01) |
| ***D06N 7/00*** | (2006.01) |

(52) U.S. Cl.
CPC ..... *D06N 3/0036* (2013.01); *D06N 3/0077* (2013.01); *D06N 3/06* (2013.01); *D06N 3/065* (2013.01); *D06N 7/0002* (2013.01); *D06N 2211/26* (2013.01); *D10B 2331/04* (2013.01); *D10B 2505/08* (2013.01); *D10B 2505/12* (2013.01)

(58) Field of Classification Search
CPC .... D06N 3/042; D06N 3/065; D06N 2211/26; D04H 3/14; D04H 3/011; D10B 2331/04; D10B 2505/08; D10B 2505/12
See application file for complete search history.

(56) References Cited

FOREIGN PATENT DOCUMENTS

| | | |
|---|---|---|
| JP | S64077666 | 3/1989 |
| JP | H02127554 | 5/1990 |
| JP | H05116261 | 5/1993 |
| JP | H07125066 | 5/1995 |
| JP | H11241277 | 9/1999 |
| JP | 2012056245 | 3/2012 |
| JP | 2013032601 | 2/2013 |

OTHER PUBLICATIONS

Japanese Patent Office, International Search Report for Application No. PCT/JP2013/073541 dated Oct. 8, 2013.
Office Action for Chinese Patent Application No. 201380074901.9, dated Jun. 1, 2016 (with translation).

* cited by examiner

[Figure 1-1]
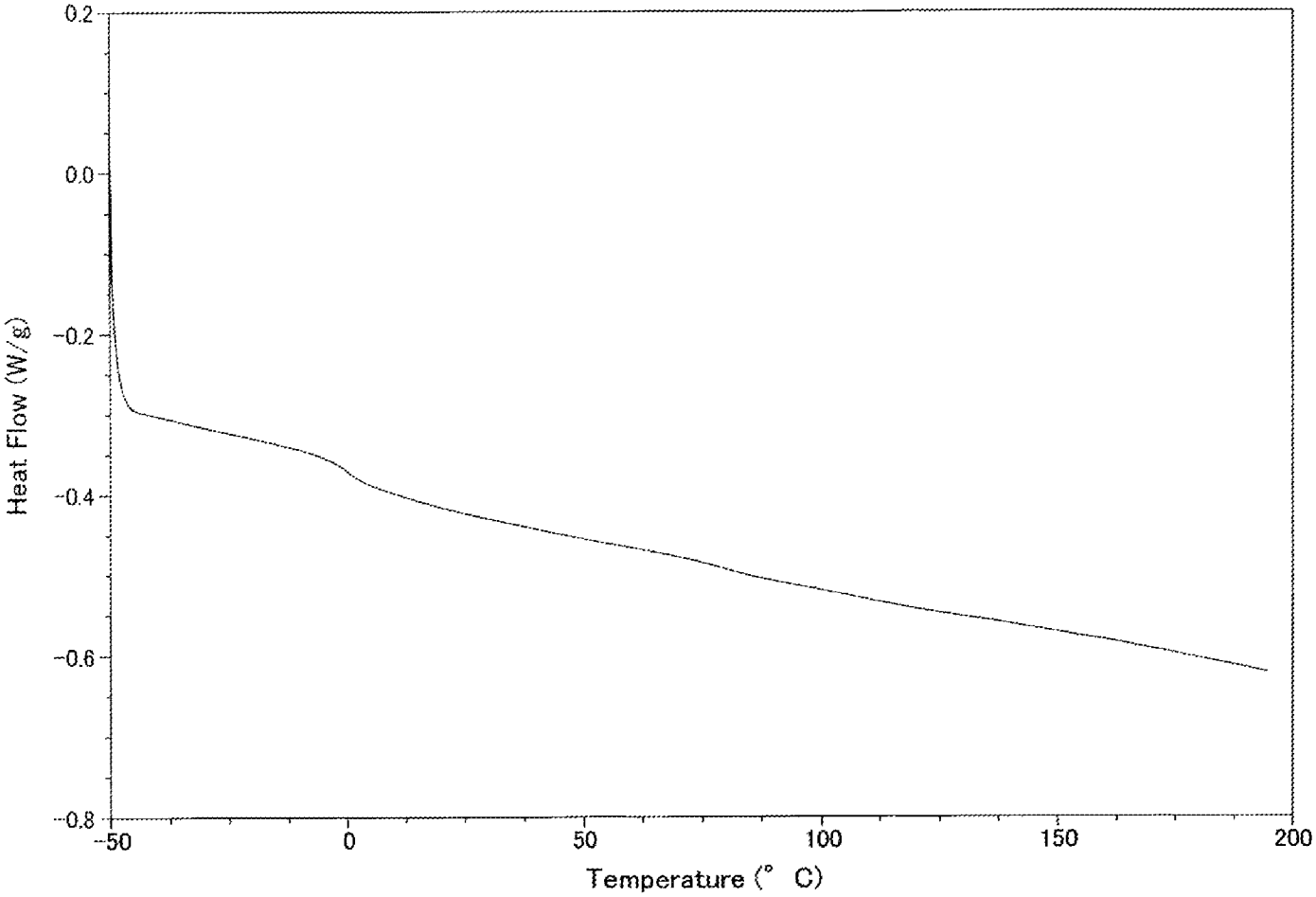

[Figure 1-2]
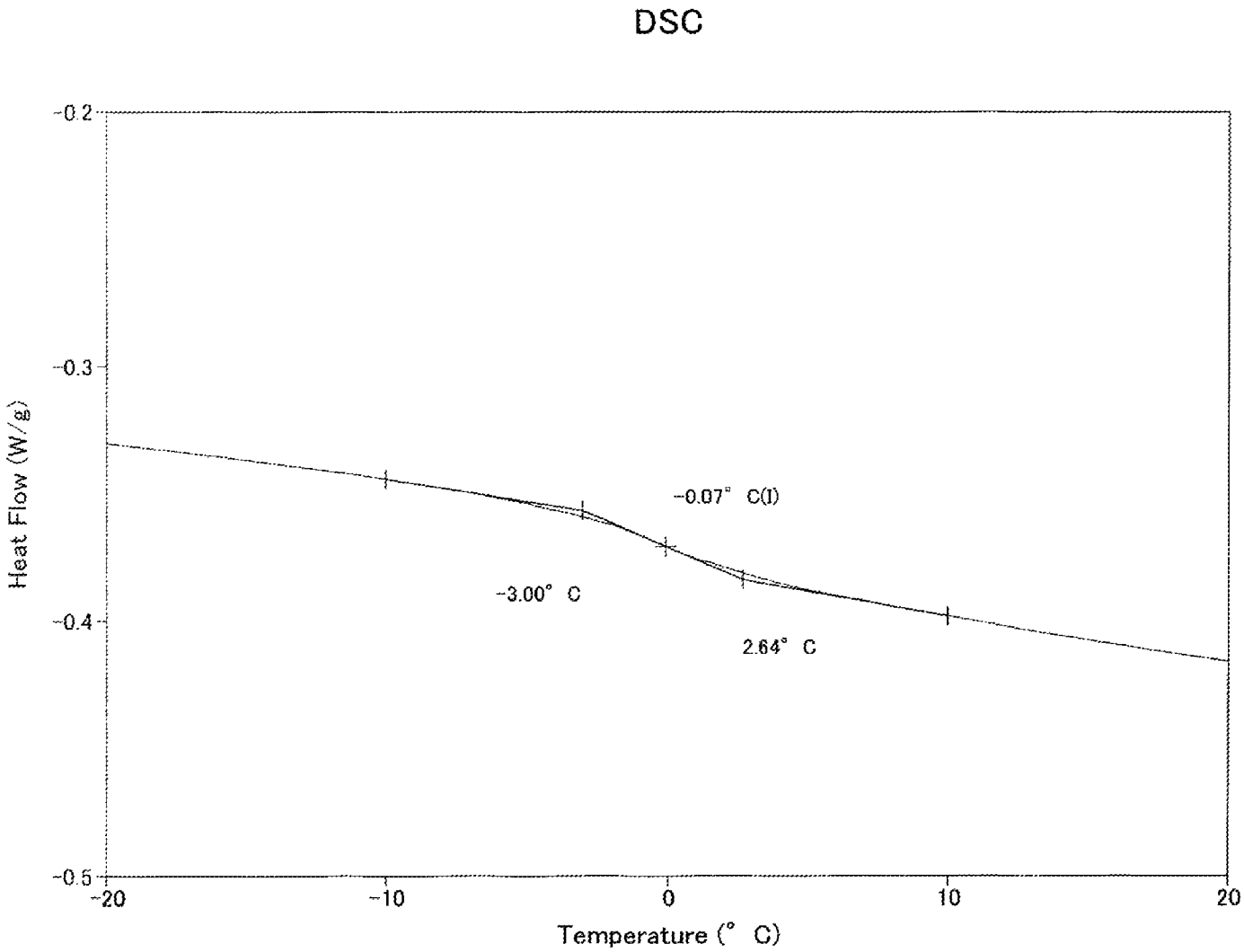

RESIN-COATED NON-WOVEN FABRIC

TECHNICAL FIELD

The present invention relates to a resin-coated non-woven fabric which is in a sheet form and is usable for a vehicle interior member, wallpaper, a bed member, a chair member and others, and in particular to a resin-coated non-woven fabric that may be welded through a high-frequency welder and may have a clear embossed pattern.

BACKGROUND ART

As the mainstream of sheets used in vehicle interior members, particularly, tonneau covers, vinyl chloride leathers, in each of which a polyvinyl chloride sheet is laminated onto a woven fabric, a knitting, a non-woven fabric or some other, have been used. The sheets may be welded through a high-frequency welder, so that labors for processing based on sewing are saved to produce an advantage in view of costs. However, the vinyl chloride leathers have a problem that a warm texture cannot be gained. From such a viewpoint, the Applicant invented an air-permeable leather in which a non-woven fabric is impregnated with a resin (Patent Document 1). However, in this invention, since the impregnation resin used is polyvinyl acetate having a high Tg (Examples in Patent Document 1), the texture may become harder when the proportion of the amount of the impregnation resin is made larger.

The Applicant further invented a leather-like non-woven fabric in which an acrylic resin is caused to adhere onto a single surface of a thermocompression-bondable type spunbonded non-woven fabric high in weight per unit area (Patent Document 2). The non-woven fabric yielded by this invention has a problem of being unable to be welded through a high-frequency welder.

PRIOR ART DOCUMENTS

Patent Documents

Patent Document 1: JP-A-07-125066
Patent Document 2: JP-A-11-241277

SUMMARY OF THE INVENTION

Problems to be Solved by the Invention

According to neither Patent Document 1 nor 2, it has been investigated whether or not the non-woven fabric may be welded through a high-frequency welder. For reference, polyvinyl acetate may be welded through a high-frequency welder; however, as described above, any non-woven fabric impregnated with polyvinyl acetate is hard in texture and is not supple. Thus, an object of the present invention is to provide a resin-coated non-woven fabric that may be welded through a high-frequency welder and may be remedied in hardness, and further may have a clear embossed pattern.

Solutions to the Problems

The present invention, which has solved the above-mentioned problems, comprises: a filament non-woven fabric that is of a thermocompression-bondable type, is made of a polyethylene terephthalate and has a weight of 50 to 150 g/m$^2$; and a resin coat layer positioned over one surface of the filament non-woven fabric and having a coating amount of 40 to 150 g/m$^2$ after dried; wherein the resin coat layer contains 10 to 45% by mass of a vinyl chloride unit and 30 to 55% by mass of a (meth)acrylic acid ester unit, and further a surface of the resin coat layer has an embossed pattern.

It is preferred that the resin coat layer has at least one glass transition temperature (Tg) of 30° C. or lower according to differential scanning calorimetry (DSC) of the layer. It is also desired that the filament non-woven fabric is embossed, and the embossed surface of the filament non-woven fabric is coated with the above resin.

In the present invention, the wording "(meth)acrylic acid ester" means an "acrylic acid ester and/or methacrylic acid ester."

Effects of the Invention

The present invention may provide a resin-coated non-woven fabric that may be welded through a high-frequency welder and may remedied in hardness, and may have a clear embossed pattern to be excellent in design property.

BRIEF DESCRIPTION OF THE DRAWINGS

FIG. 1-1 is a graph showing a DSC curve of a coat layer sample from a resin-coated non-woven fabric produced in Example 1.

FIG. 1-2 is an enlarged graph (in a range from −20 to 20° C.) of FIG. 1-1.

MODE FOR CARRYING OUT THE INVENTION

In light of the above-mentioned prior art, the inventors have made various investigations about resins that may be welded through a high-frequency welder and be remedied in hardness, and further may realize a vivid embossed pattern, in particular, their copolymerizable component or polymer blend component to find out that a resin with which a non-woven fabric is coated has, besides a vinyl chloride unit, a (meth)acrylic acid ester unit, thereby making it possible to give suppleness to the resultant resin-coated non-woven fabric without hindering the non-woven fabric in weldability through a high-frequency welder, and further give a vivid embossed pattern to the non-woven fabric. Thus, the present invention has been accomplished. Hereinafter, the present invention will be described in detail.

[Non-Woven Fabric]

The non-woven fabric used in the present invention, which is a substrate, is a filament non-woven fabric that is of a thermocompression bondable type and is made of a polyethylene terephthalate (PET). This is because the PET is excellent in dynamic strengths (mechanical strengths), heat resistance, and other properties. A polyester other than the PET may be blended therewith as far as the proportion of the polyester is 10% by mass or less. The intrinsic viscosity of the PET is not particularly limited, and is preferably 0.6 dl/g or more.

The fiber diameter of the long fiber (monofilament) constituting the non-woven fabric is preferably from about 0.1 to 10 dtex, more preferably from about 1 to 5 dtex. In the present invention, a non-woven fabric is used which has a weight of about 50 to 150 g/m$^2$, preferably about 60 to 120 g/m$^2$, more preferably 70 to 110 g/m$^2$. When the fiber diameter and the weight are in these ranges, respectively, the resultant resin-coated non-woven fabric may be made excellent in dynamic strengths, suppleness, design property and other properties in a balanced manner.

The filament non-woven fabric is preferably a spunbonded non-woven fabric since it is suitable for being produced at a high speed and is available at low costs. When the filament non-woven fabric is a spunbonded non-woven fabric without being subjected to any work, the non-woven fabric may be somewhat short in tensile strength or tear strength. Thus, in the present invention, the used spunbonded non-woven fabric is a non-woven fabric obtained by passing a spunbonded non-woven fabric through an embossing roll having a compression ratio (proportion by area of tops of convex portions of the roll) of about 2 to 50% so as to be compressed. The compression through the embossing roll makes the non-woven fabric high in shape retainability, and makes it difficult that the non-woven fabric gets out of shape when transferred. The spunbonded non-woven fabric is preferably a non-woven fabric having only one embossed surface in view of costs.

[Resin]

The resin-coated non-woven fabric of the present invention has a resin coat layer on one surface of the filament non-woven fabric. The resin constituting the resin coat layer needs to be a resin containing a vinyl chloride unit and a (meth)acrylic acid ester unit. The vinyl chloride unit makes the resin-coated non-woven fabric weldable through a high-frequency welder, and the (meth)acrylic acid ester unit gives a favorable softness (flexibility) to the resin.

The (meth)acrylic acid ester unit means a structural unit originating from a monomer having a (meth)acryloyl group. Examples of the monomer resulting in such a structural unit include methyl (meth)acrylate, ethyl (meth)acrylate, butyl (meth)acrylate, 2-ethylhexyl (meth)acrylate, cyclohexyl (meth)acrylate, benzyl (meth)acrylate, 2-hydroxyethyl (meth)acrylate, and other (meth)acrylates.

The vinyl chloride unit is contained in the resin coat layer in a proportion of 10 to 45% by mass of this layer (the proportion of the total of the resin constituting the coat layer and optionally used additives is 100% by mass). When the proportion of the unit is within this range, the resin-coated non-woven fabric may be welded through a high-frequency welder, and does not become too hard. The content of the vinyl chloride unit ranges preferably from 15 to 45% by mass, more preferably from 15 to 35% by mass.

The (meth)acrylic acid ester unit is contained in the resin coat layer in a proportion of 30 to 55% by mass of the layer. If the proportion of the (meth)acrylic acid ester unit becomes large, the surface of the resultant resin-coated non-woven fabric becomes tacky. Thus, for example, when the resin-coated non-woven fabric that is in a rolled-up state is unwound, the non-woven fabric may unfavorably undergo blocking. Conversely, if the proportion of the (meth)acrylic acid ester unit becomes too small, suppleness is not easily given to the resin-coated non-woven fabric. Thus, the content of the (meth)acrylic acid ester unit ranges preferably from 30 to 50% by mass, more preferably from 35 to 45% by mass.

The respective contents of the (meth)acrylic acid ester unit and the vinyl chloride unit are measurable by NMR and others. The contents may also be calculated out from the use amounts of the monomer components or the blend composition of the resin composition, or may be gained with reference to nominal values thereof according to a manufacturer of the resin.

An embodiment in which the vinyl chloride unit and the (meth)acrylic acid ester unit are contained in the resin coat layer is, for example, an embodiment (1) in which the resin is a copolymer (or a terpolymer or any higher multi-component copolymer) having a vinyl chloride unit and a (meth)acrylic acid ester unit; or an embodiment (2) in which the resin contains a mixture of a (co) copolymer having a vinyl chloride unit and a (co)polymer containing a (meth) acrylic acid ester unit. An embodiment in which the embodiments (1) and (2) are mixed with each other is also usable. The (co)polymer means a homopolymer or a copolymer.

In the embodiment (1), the copolymer may contain one or more units different from the vinyl chloride unit and the (meth)acrylic acid ester unit. Examples of a monomer resulting in the different unit(s) include ethylene, vinyl acetate, styrene, acrylonitrile, acrylic acid, and methacrylic acid.

When the different unit(s) is/are present, that is, the different monomer(s) is/are copolymerized with the (meth) acrylic acid ester and vinyl chloride, it is preferred to adjust the copolymerization ratio to set the respective proportions of the vinyl chloride unit and the (meth)acrylic acid ester unit in the resin coat layer into the above-mentioned ranges.

The embodiment (2) is classified into an embodiment (2-1) in which the resin contains a mixture of a homo-poly (meth)acrylate and polyvinyl chloride; an embodiment (2-2) in which the resin contains a mixture of a homo-poly(meth) acrylate and a copolymer containing a vinyl chloride unit; an embodiment (2-3) in which the resin contains a mixture of a copolymer containing a (meth)acrylic acid ester unit and polyvinyl chloride; and an embodiment (2-4) in which the resin contains a mixture of a copolymer containing a (meth) acrylic acid ester unit and a copolymer containing a vinyl chloride unit. In the embodiments (2-2) to (2-4), the units constituting each of the copolymers are units originating from the monomer resulting in the above-mentioned different unit(s), examples of this monomer described above.

In the present invention, the resin with which the non-woven fabric is coated may be a resin further containing a (co)polymer containing neither any vinyl chloride unit nor any (meth)acrylic acid ester unit. In other words, the embodiment referred to herein is the embodiment (3), in which a (co)copolymer obtained by polymerizing one or more monomers resulting the above-mentioned different unit(s), examples of the monomer(s) described above, is incorporated into the embodiment (1) or (2). In the embodiment (3), the (co)polymer containing neither any vinyl chloride unit nor any (meth)acrylic acid ester unit is preferably a copolymer made from ethylene and vinyl acetate. In this copolymer, the copolymerization is preferably attained to set the proportion of the unit of vinyl acetate into the range of 60 to 95% by mass.

In any one of the above-mentioned cases, it is preferred to adjust the proportion of the vinyl chloride unit in the resin coat layer, and that of the (meth)acrylic acid ester unit therein into the range of 10 to 45% by mass, and that of 30 to 55% by mass, respectively.

The resin related to the present invention is preferably a resin having at least one glass transition temperature (Tg) of 30° C. or lower according to differential scanning calorimetry (DSC) thereof. The glass transition temperature denotes a glass transition temperature obtained from a DSC curve obtained by using a differential scanning calorimeter to measure an exothermic and endothermic curve (DSC curve) of the resin at a heating rate of 20° C./min. When the component having a glass transition temperature of 30° C. or lower is used, suppleness may be given to the resin-coated non-woven fabric.

The resin related to the present invention may have plural glass transition temperatures. In this case, it is sufficient that at least one of the glass transition temperatures is 30° C. or lower. When the resin has plural glass transition temperatures, the lowest glass transition temperature is preferably −30° C. or higher, and the highest glass transition temperature is preferably 80° C. or lower. If the glass transition temperature is too low, the resin becomes tacky so that the resin-coated non-woven fabric may unfavorably undergo blocking. If the glass transition temperature is too high, the non-woven fabric may not easily gain desired suppleness.

The resin for the coating is preferably in the form of an emulsion of an aqueous medium although the resin may be in an organic solvent form. When the resin is composed of plural (co)polymers, a homogeneous resin emulsion may be easily obtained by mixing respective emulsions of the (co) polymers with each other and then stirring the mixture. Moreover, the viscosity of the resultant resin emulsion (coating liquid) may also be controlled into a low value, and further this manner is friendly to the environment. The aqueous medium may contain, besides water, an alcohol such as methanol, ethanol or isopropanol; a ketone such as acetone; and/or an ether such as tetrahydrofuran.

The resin is a resin with which a non-woven fabric is to be coated to give a resin amount (non-volatile content) of 40 to 150 g/m$^2$. If the resin amount is too small, the resin-coated non-woven fabric cannot have a clear embossed pattern. If the resin amount is too large, the non-woven fabric unfavorably becomes hard in texture. The adhesion amount is more preferably from 50 to 120 g/m$^2$. The adhesion amount is even more preferably from 60 to 110 g/m$^2$. In order to set the adhesion amount based on the coating within the preferred range, it is advisable to adjust the concentration in the emulsion. The resin with which the non-woven fabric is coated may be present on a surface of the non-woven fabric. The resin may be present in the non-woven fabric in a resin-impregnated state, that is, be present in the state of penetrating gaps between the fiber filaments constituting the non-woven fabric, or other moieties.

[Resin Composition]

When the non-woven fabric is coated with the resin in the present invention, known additives may be added to the resin (emulsion) as far as the addition does not hinder the object of the present invention, examples of the additives including a crosslinking agent, a flame retardant, a wetting agent, a viscosity adjustor, a thickener, an antifoaming agent, a modifier, a pigment, a colorant, a filler, an antiaging agent, an ultraviolet absorber, and an ultraviolet stabilizer. The resin is preferably used in the form of a resin composition obtained by mixing the resin with one or more of these additives. The proportion of the added additive(s) in the resin composition is preferably from 10 to 50% by mass, more preferably from 15 to 45% by mass, even more preferably from 20 to 40% by mass of the resin composition (the total proportion (100% by mass) of the resin, the solvent, and the additive(s), which is/are, for example, a filler and/or a flame retardant).

In order to give flame retardancy to the resin-coated non-woven fabric, it is preferred that the resin composition contains antimony trioxide. In a preferred embodiment, the proportion of added antimony trioxide is from about 5 to 10% by mass (the total proportion by mass of the resin and antimony trioxide is 100% by mass).

[Method for Producing the Resin-Coated Non-Woven Fabric]

A description will be made about a preferred example of a method for producing the resin-coated non-woven fabric of the present invention. First, a spunbonded non-woven fabric is produced by a known method. Subsequently, as described above, the non-woven fabric is passed through an embossing roll to be compressed. In this way, a non-woven fabric as a substrate is completed. At this time, it is advisable to conduct the embossing at about 150 to 250° C.

Next, at least one surface of this non-woven fabric substrate is coated with a resin composition. Preferably, a resin coat is applied to the embossed surface, which has been produced in the production of the non-woven fabric. According to the application of the resin coat to the embossed surface produced in the production of the non-woven fabric, ends in the width direction of the resin-coated non-woven fabric may be prevented from being curled. By the coating of the resin composition, the resin invades the inside of the non-woven fabric. However, the resin does not necessarily reach the surface of the non-woven fabric that is opposite to the coated surface thereof (or turn into a state that the resin infiltrates sufficiently up to the rear surface), so that the resultant resin-coated non-woven fabric may be separated into a layer in which the non-woven fabric is impregnated with the resin, and a layer of only the non-woven fabric impregnated with no resin. A difference in thermal shrinkage behavior between these two layers would cause the curling. According to the application of the embossing in the non-woven fabric production, filaments of portions of the non-woven fabric have been made dense, these portions having been compressed through convex portions of the embossing roll. However, filaments of portions thereof that have not been compressed are sparse or thin as they are. Consequently, the application of the resin coating onto the non-woven fabric from the embossed surface side thereof makes it easy that the non-woven fabric is impregnated through the sparse-filament-portions with the resin. This matter would restrain the curling. The value of the curling, which is measured by a measuring method that will be later described, is preferably 20 mm or less. The value is more preferably 18 mm or less, even more preferably 15 mm or less.

The method for the coating is not particularly limited, and may be, for example, a knife coating, gravure coating, or air knife coating method. From the viewpoint of good penetrating performance, preferred is a knife coating or air knife coating method.

From these methods, an appropriate method is selectable in accordance with the amount of the resin for the coating, the viscosity of the resin composition, and others. The number of times of the coating is not particularly limited, and may be any number as far as the resin amount in the non-woven fabric is included within the above-mentioned range. The coated non-woven fabric may be thermally treated to be dried. Conditions for the thermal treatment are not particularly limited. It is advisable to conduct the treatment, for example, at 100 to 160° C. (more preferably, 110 to 150° C.) for 0.5 to 10 minutes (more preferably, 1 to 5 minutes).

It is preferred to pass the resultant resin-coated non-woven fabric through an embossing roll to apply a rugged pattern to at least one surface of the non-woven fabric. The embossing is preferably applied to the resin-coated surface of the non-woven fabric. This case may give a more vivid embossed pattern. The embossed pattern is not particularly limited, and may be, for example, a leather-like, satin-like, wood-grain-like or fabric-texture-like pattern, or a geometric pattern (for example, a columnar form, a polygonal prism form such as a triangular prism or quadratic prism form, a truncated cone form, or a polygonal pyramid frustum form such as a triangular pyramid frustum or quadrangular pyramid frustum form). It is advisable to decide the embossed pattern appropriately in accordance with a design desired for the fabric. It is recommendable from the viewpoint of remedy of the tackiness to use an embossed pattern having a shape that will be later described. It is preferred to use a paper roll as a roll facing the embossing roll. By the use of the paper roll, concave portions corresponding to the convex portions of the embossing roll are formed in the paper roll. Thus, embossed patterns, which are rugged patterns, may be formed at a time onto both surface of the resin-coated non-woven fabric, respectively. It is preferred to conduct the embossing while the resin-coated non-woven fabric is heated to have a temperature of about 130 to 180° C.

[Resin-Coated Non-Woven Fabric]

The resin-coated non-woven fabric of the present invention may be welded through a high-frequency welder. A standard as to whether or not a non-woven fabric may be welded is that a high-frequency welder welded portion thereof shows a tensile (breaking) strength of 5.0 N/cm or more. The strength of the welded portion is preferably 7 N/cm or more, more preferably 8 N/cm or more. A method for measuring the strength of the welded portion will be described in Examples.

The resin-coated non-woven fabric of the present invention has suppleness (flexibility) since the content of the (meth)acrylic acid ester unit is set into the appropriate range. About a standard of the flexibility, the distance according to a cantilever manner (JIS L 1913 6.7.2 (2010)) is preferably from 80 to 160 mm. The distance is more preferably from 90 to 140 mm, even more preferably from 100 to 130 mm.

Furthermore, the resin-coated non-woven fabric of the present invention has an embossed pattern. Embossing making use of a specified shape is useful for remedying the resin-coated non-woven fabric in tackiness when the non-woven fabric is wound up into a roll form, as well as for giving a design property. Thus, the expression of the stickiness (tackiness) is prevented not to cause inconveniences, such as blocking, easily.

Specifically, when the resin-coated non-woven fabric is wound into a roll form, the resin-coated surfaces, or the resin-coated surface and the non-woven surface come to contact each other to cause bleeding of the resin component, or make the resin coat layer soft to cause the tackiness thereof. This tackiness phenomenon is more easily caused when the resin contains the vinyl chloride unit. In the case of using the resin-coated non-woven fabric of the present invention, particularly, for a tonneau cover of an automobile, the tonneau cover is wound in a roll form when not used, and unwound when used. Here, the generation of the tackiness may cause crunching sounds when the tonneau cover is unwound. The sounds are generated as follows: when the whole of the resin composition is low in hardness, the resin-coated surfaces, or the resin-coated surface and the non-woven surface undergo blocking by the effect of the tackiness, so that the sounds are generated when the two layers are peeled from each other. Such crunching sounds have been required to be decreased.

The form of the embossments is not particularly limited, and is preferably a form which may give the following form to the resin-coated non-woven fabric: for example, a leather-like, satin-like, wood-grain-like or fabric-texture-like pattern, or a geometric pattern (for example, a columnar form, a polygonal prism form such as a triangular prism or quadratic prism form, a truncated cone form, or a polygonal pyramid frustum form such as a triangular pyramid frustum or quadrangular pyramid frustum form). Of these forms, a quadrangular pyramid frustum form is preferred since this form is excellent in the effect of decreasing crunching sounds resulting from the tackiness.

About the size of the embossments, the following length is preferably from 500 to 2000 μm (more preferably from 700 to 1600 μm, even more preferably from 1000 to 1300 μm): the length obtained in the case of selecting any two points on an outline of the embossed pattern in the plane of the resin-coated non-woven fabric to make the length between these points maximum. The height of the embossments is preferably from 250 to 700 μm (more preferably from 300 to 650 μm, even more preferably from 350 to 600 μm).

Examples of the arrangement of the embossments in the resin-coated non-woven fabric include one in which embossments are arranged into a lattice form, one in which embossments are arranged into a staggered form, one in which embossments are arranged at random, and one in which embossments are like skin-grains. The form of the embossments is most preferably a form in which concave portions of a reverse quadrangular pyramid frustum form are arranged into a staggered form when the form is viewed from the resin coat surface side thereof (when both surfaces of the non-woven fabric are coated with the resin, either one of the surfaces may be viewed).

The present application claims the benefit of a priority based on Japanese Patent Application No. 2013-56800 filed on Mar. 19, 2013. The entire contents of the specification of Japanese Patent Application No. 2013-56800 filed on Mar. 19, 2013 are incorporated into the present application for reference.

EXAMPLES

Hereinafter, the present invention will be described in more detail by way of working examples. The examples do not restrict the present invention. Any embodiment to be carried out in the state that a modification is added to any one of the examples is included in the technical scope of the invention as far as the modified embodiment does not depart from the subject matter of the present invention. Unless otherwise specified, the word "part(s) and the symbol "%" denote "part(s) by mass" and "% by mass," respectively.

[Property Evaluation Methods]

<Weight of Non-Woven Fabric>

About the weight per unit area of any non-woven fabric, a measurement was made about a piece thereof 20 cm×20 cm in size in accordance with a method described in JIS L 1906 5.2 (2000).

<Glass Transition Temperature (Tg)>

The glass transition temperature of a resin was measured in accordance with JIS K7121.

From a non-woven fabric coated with the resin, a portion of the non-woven fabric, which is a substrate, was cut away with a single-edged cutter to collect samples of the resin coat layer each about 5 mg in weight. A differential scanning calorimeter (DSC, "Q100" manufactured by TA instruments) was used to raise the temperature of one of the samples that had been kept at −50° C. for 2 minutes in a nitrogen gas flow from −50° C. to 200° C. at a heating rate of 20° C./min, and then the sample was cooled rapidly to −50° C. The temperature of the sample was again raised to 200° C. at a heating rate of 20° C./min. An exothermic and endothermic curve (DSC curve) obtained at this time was measured. In the resultant DSC curve, a base line of each of its high temperature region and low temperature region was extended; and then the following point was read out: a point where a straight line any point of which has an equal distance from the extended straight line in the vertical axis direction crosses a curve of a stepwise changed portion of the glass transition of the sample. This point was defined as the glass transition temperature (° C.).

<Design Property>

A resin-coated non-woven fabric in which a thermally compressed mark of a non-woven fabric was not observed and an embossed pattern was clear is judged to be "○"; one in which an embossed pattern was unclear, in other words, a pattern different from the pattern of the embossing roll used for the embossing was formed, to be "Δ"; and one in which no embossed pattern was observed and a thermally compressed mark of a non-woven fabric was visible, to be "x"

<Curling>

A resin-coated non-woven fabric was cut into a sample 75 mm in width and 205 mm in length. The sample was allowed to stand still in a bone-dry state at 90° C. for 24 hours. The maximum warp height (mm) of a warped-up side portion of the sample was measured.

<Bending Resistance (Flexibility)>

The degree thereof was measured in a cantilever manner described in JIS L 1913 6.7.2 (2010). A sample therefor was prepared to make the length direction of the sample consistent with the length direction of the non-woven fabric when the non-woven fabric was produced (hereinafter, the same matter is applied to the measurements of the tensile (breaking) strength of a high-frequency welder welded portion, and the strength).

<Tensile (Breaking) Strength of High-Frequency Welder Welded Portion>

A high-frequency welder working machine (new model hybrid high-frequency welder, YO-5AN, manufactured by Yamamoto Vinita Co., Ltd.) was used to weld resin coat layers of a resin-coated non-woven fabric to each other in a liner form at 0.25 A at a mold temperature of 150° C. under conditions of a welding period of 3 seconds and a cooling period of 3 seconds to produce a sample. From the sample, a test specimen was cut away to set the length thereof in the direction perpendicular to the welded portion to about 200 mm, set the length thereof in the same direction as the welded portion was extended (the length corresponds to the width of the test specimen) to 30 mm, and position the welded portion near the center of the test specimen. The test specimen was sandwiched between upper and lower chucks of a tensile tester ("AUTOGRAPH (registered trade name)" manufactured by Shimadzu Corp.) to set the distance between the chucks to 100 mm, and then the specimen was pulled at a pulling rate of 200 mm/min. The strength obtained when the welded portion was broken was divided by the length in the width direction of the test specimen. The resultant value was defined as the tensile strength (N/cm).

<Strength>

A sample cut away into a width of 30 mm and a length of 200 mm was sandwiched between upper and lower chucks of a tensile tester ("AUTOGRAPH (registered trade name)" manufactured by Shimadzu Corp.) to set the distance between the chucks to 100 mm, and then the sample was pulled at a pulling rate of 200 mm/min. When the sample was broken, the resultant numerical value was read out.

Example 1

A polyethylene terephthalate (PET) having an intrinsic viscosity of 0.65 dl/g was used to be melt-spun at a spinning temperature of 285° C. and a single-hole-jetting-out amount of 1.0 g/min. The resultant was subjected to fiber opening while pulled by means of an ejector. While the pulling rate was adjusted to make the arrangement of filaments thereof random on a net conveyer, the filaments were deposited thereon. This process gave a spunbonded non-woven fabric having a weight of 100 g/m$^2$ and made of a long fiber having a monofilament fineness of 2.0 dtex. Next, an embossing roll having a compression area proportion of 9%, in which convex portions each having a polygonal pyramid frustum shape were arranged in a staggered form, was used to emboss the non-woven fabric at 230° C. and a linear pressure of 20 kN/m to yield a thermocompression-bondable type filament non-woven fabric.

The following were sufficiently mixed with one another: a copolymer emulsion made from vinyl chloride and an acrylic acid ester ("VINYBLAN (registered trade name) 278," manufactured by Nissin Chemical Industry Co., Ltd.; vinyl chloride/acrylic acid ester=80/20) in an amount of 30 parts as the amount of solid therein; an acrylic acid ester polymer emulsion ("NEW COAT 9500," manufactured by Shin-Nakamura Chemical Co., Ltd.) in an amount of 34 parts as the amount of solid therein; and calcium carbonate ("ESCALON #100," manufactured by Sankyo Seifun Co., Ltd.) as an extender in an amount of 36 parts. In this way, a resin composition 1 was yielded.

A knife coater was used to coat the front surface (embossed surface) of the thermocompression-bondable type filament non-woven fabric with the resin composition 1 so that a resin adhesion amount is 80 g/m$^2$ after the resin is dried. The resultant workpiece was then dried, and then a geometric-pattern type embossing roll was used to emboss the workpiece at 153° C. and a linear pressure of 70 kN/m to yield a resin-coated non-woven fabric. The non-woven fabric was evaluated about the design property, the curling, the bending resistance, and the tensile (breaking) strength and the strength of the welder welded portion thereof by the above-mentioned methods. The results are shown in Table 1. A DSC curve obtained at this time is shown in FIG. 1-1, and an enlarged view thereof (in a range of −20 to 20° C.) is shown in FIG. 1-2.

Example 2

A thermocompression-bondable type filament non-woven fabric was yielded in the same way as in Example 1.

The following were sufficiently mixed with one another: a copolymer emulsion made from vinyl chloride and an acrylic acid ester ("VINYBLAN (registered trade name) 271," manufactured by Nisshin Chemical Co., Ltd.; vinyl chloride/acrylic acid ester=50/50) in an amount of 30 parts as the amount of solid therein; an acrylic acid ester polymer emulsion ("YODOSOL AD133," manufactured by Henkel Japan Ltd.) in an amount of 35 parts as the amount of solid therein; and calcium carbonate ("ESCALON #100," manufactured by Sankyo Seifun Co., Ltd.) as an extender in an amount of 35 parts. In this way, a resin composition 2 was yielded.

A knife coater was used to coat the front surface (embossed surface) of the same thermocompression-bondable type filament non-woven fabric as described above with the resin composition 2 so that a resin adhesion amount is 80 g/m$^2$ after the resin is dried. The resultant workpiece was then dried, and then a geometric-pattern type embossing roll was used to emboss the workpiece at 153° C. and a linear pressure of 70 kN/m to yield a resin-coated non-woven fabric. Evaluation results of the various properties thereof are shown in Table 1.

Example 3

A thermocompression-bondable type filament non-woven fabric was yielded in the same way as in Example 1. The following were sufficiently mixed with one another: a copolymer emulsion made from vinyl chloride and an acrylic acid ester ("VINYBLAN (registered trade name) 271," manufactured by Nissin Chemical Industry Co., Ltd.; vinyl chloride/acrylic acid ester=50/50) in an amount of 70 parts as the amount of solid therein; and calcium carbonate ("ESCALON #100," manufactured by Sankyo Seifun Co., Ltd.) as an extender in an amount of 30 parts. In this way, a resin composition 3 was yielded.

A knife coater was used to coat the front surface (embossed surface) of the thermocompression-bondable type filament non-woven fabric with the resin composition 3 so that a resin adhesion amount is 80 g/m$^2$ after the resin is dried. The resultant workpiece was then dried, and then a skin-grains-pattern type embossing roll was used to emboss the workpiece at 153° C. and a linear pressure of 70 kN/m to yield a resin-coated non-woven fabric. Evaluation results of the various properties thereof are shown in Table 1.

Example 4

A thermocompression-bondable type filament non-woven fabric was yielded in the same way as in Example 1.

The following were sufficiently mixed with one another: a copolymer emulsion made from vinyl chloride and an acrylic acid ester ("VINYBLAN (registered trade name) 278," manufactured by Nissin Chemical Industry Co., Ltd.; vinyl chloride/acrylic acid ester=80/20) in an amount of 20 parts as the amount of solid therein; an acrylic acid ester polymer emulsion ("NEW COAT 9500," manufactured by Shin-Nakamura Chemical Co., Ltd.) in an amount of 51 parts as the amount of solid therein; and calcium carbonate ("ESCALON #100," manufactured by Sankyo Seifun Co., Ltd.) as an extender in an amount of 29 parts. In this way, a resin composition 4 was yielded.

A knife coater was used to coat the front surface (embossed surface) of the thermocompression-bondable type filament non-woven fabric with the resin composition 4 so that a resin adhesion amount is 80 g/m$^2$ after the resin is dried. The resultant workpiece was then dried, and then a skin-grains-pattern type embossing roll was used to emboss the workpiece at 153° C. and a linear pressure of 70 kN/m to yield a resin-coated non-woven fabric. Evaluation results of the various properties thereof are shown in Table 1.

Example 5

A polyethylene terephthalate (PET) having an intrinsic viscosity of 0.65 dl/g was used to be melt-spun at a spinning temperature of 285° C. and a single-hole-jetting-out amount of 1.0 g/min. The resultant was subjected to fiber opening while pulled by means of an ejector. While the pulling rate was adjusted to make the arrangement of filaments thereof random on a net conveyer, the filaments were deposited thereon. This process gave a spunbonded non-woven fabric having a weight of 150 g/m$^2$ and made of a long fiber having a monofilament fineness of 2.0 dtex. Next, an embossing roll having a compression area proportion of 9%, in which convex portions each having a polygonal pyramid frustum shape were arranged in a staggered form, was used to emboss the non-woven fabric at 230° C. and a linear pressure of 20 kN/m to yield a thermocompression-bondable type filament non-woven fabric.

Except that a knife coater was used to coat with the resin composition 1 so that a resin adhesion amount is 150 g/m$^2$ after the resin is dried, the same procedure as in Example 1 was carried out to yield a resin-coated non-woven fabric. Evaluation results of the various properties thereof are shown in Table 1.

Example 6

A polyethylene terephthalate (PET) having an intrinsic viscosity of 0.65 dl/g was used to be melt-spun at a spinning temperature of 285° C. and a single-hole-jetting-out amount of 1.0 g/min. The resultant was subjected to fiber opening while pulled by means of an ejector. While the pulling rate was adjusted to make the arrangement of filaments thereof random on a net conveyer, the filaments were deposited thereon. This process gave a spunbonded non-woven fabric having a weight of 50 g/m$^2$ and made of a long fiber having a monofilament fineness of 2.0 dtex. Next, an embossing roll having a compression area proportion of 9%, in which convex portions each having a polygonal pyramid frustum shape were arranged in a staggered form, was used to emboss the non-woven fabric at 230° C. and a linear pressure of 20 kN/m to yield a thermocompression-bondable type filament non-woven fabric.

Except that a knife coater was used to coat with the resin composition 1 so that a resin adhesion amount is 50 g/m$^2$ after the resin is dried, the same procedure as in Example 1 was carried out to yield a resin-coated non-woven fabric. Evaluation results of the various properties thereof are shown in Table 1.

Example 7

A resin-coated non-woven fabric was yielded in the same way as in Example 1 except that the non-embossed surface of the filament non-woven fabric was coated with the resin composition 1. Evaluation results of the various properties thereof are shown in Table 1.

Example 8

A thermocompression-bondable type filament non-woven fabric was yielded in the same way as in Example 1.

The following were sufficiently mixed with one another: a copolymer emulsion made from vinyl chloride and an acrylic acid ester ("VINYBLAN (registered trade name) 701," manufactured by Nissin Chemical Industry Co., Ltd.; vinyl chloride/acrylic acid ester=80/20) in an amount of 30 parts as the amount of solid therein; an acrylic acid ester polymer emulsion ("SAIBINOL ACF-15," manufactured by Saiden Chemical Co., Ltd.) in an amount of 34 parts as the amount of solid therein; and calcium carbonate ("ESCALON #100," manufactured by Sankyo Seifun Co., Ltd.) as an extender in an amount of 36 parts. In this way, a resin composition 8 was yielded.

A knife coater was used to coat the front surface (embossed surface) of the thermocompression-bondable type filament non-woven fabric with the resin composition 8 so that a resin adhesion amount is 80 g/m$^2$ after the resin is dried. The resultant workpiece was then dried, and then a geometric-pattern type embossing roll was used to emboss the workpiece at 153° C. and a linear pressure of 70 kN/m to yield a resin-coated non-woven fabric. Evaluation results of the various properties thereof are shown in Table 1.

Comparative Example 1

A thermocompression-bondable type filament non-woven fabric was yielded in the same way as in Example 1.

The following were sufficiently mixed with one another: a copolymer emulsion made from vinyl chloride and an acrylic acid ester ("VINYBLAN (registered trade name) 278," manufactured by Nissin Chemical Industry Co., Ltd.; vinyl chloride/acrylic acid ester=80/20) in an amount of 40 parts as the amount of solid therein; and calcium carbonate ("ESCALON #100," manufactured by Sankyo Seifun Co., Ltd.) as an extender in an amount of 60 parts. In this way, a resin composition 9 was yielded.

A knife coater was used to coat the front surface (embossed surface) of the thermocompression-bondable type filament non-woven fabric with the resin composition 9 so that a resin adhesion amount is 80 g/m$^2$ after the resin is dried. The resultant workpiece was then dried, and then a trapezoidal-grating-pattern type embossing roll was used to emboss the workpiece at 153° C. and a linear pressure of 70 kN/m to yield a resin-coated non-woven fabric. The non-woven fabric was evaluated about the design property, the curling, the bending resistance, and the tensile (breaking) strength and the strength of the welder welded portion thereof by the above-mentioned methods. The results are shown in Table 2.

Comparative Example 2

A thermocompression-bondable type filament non-woven fabric was yielded in the same way as in Example 1.

The following were sufficiently mixed with one another: a copolymer emulsion made from vinyl chloride and an acrylic acid ester ("VINYBLAN (registered trade name) 278," manufactured by Nissin Chemical Industry Co., Ltd.; vinyl chloride/acrylic acid ester=80/20) in an amount of 30 parts as the amount of solid therein; a copolymer emulsion made from vinyl chloride and an acrylic acid ester ("VINYBLAN (registered trade name) 271," manufactured by Nissin Chemical Industry Co., Ltd.; vinyl chloride/acrylic acid ester=50/50) in an amount of 50 parts as the amount of solid therein; and calcium carbonate ("ESCALON #100," manufactured by Sankyo Seifun Co., Ltd.) as an extender in an amount of 20 parts. In this way, a resin composition 10 was yielded.

A knife coater was used to coat the front surface (embossed surface) of the thermocompression-bondable type filament non-woven fabric with the resin composition 10 so that a resin adhesion amount is 80 g/m$^2$ after the resin is dried. The resultant workpiece was then dried, and then a trapezoidal-grating-pattern type embossing roll was used to emboss the workpiece at 153° C. and a linear pressure of 70 kN/m to yield a resin-coated non-woven fabric. Evaluation results of the various properties thereof are shown in Table 2.

Comparative Example 3

A thermocompression-bondable type filament non-woven fabric was yielded in the same way as in Example 1.

The following were sufficiently mixed with one another: a copolymer emulsion made from vinyl chloride and an acrylic acid ester ("VINYBLAN (registered trade name) 278," manufactured by Nissin Chemical Industry Co., Ltd.; vinyl chloride/acrylic acid ester=80/20) in an amount of 10 parts as the amount of solid therein; an acrylic acid ester polymer emulsion ("NEW COAT 9500," manufactured by Shin-Nakamura Chemical Co., Ltd.) in an amount of 55 parts as the amount of solid therein; and calcium carbonate ("ESCALON #100," manufactured by Sankyo Seifun Co., Ltd.) as an extender in an amount of 35 parts. In this way, a resin composition 11 was yielded.

A knife coater was used to coat the front surface (embossed surface) of the thermocompression-bondable type filament non-woven fabric with the resin composition 11 so that a resin adhesion amount is 80 g/m$^2$ after the resin is dried. The resultant workpiece was then dried, and then a trapezoidal-grating-pattern type embossing roll was used to emboss the workpiece at 153° C. and a linear pressure of 70 kN/m to yield a resin-coated non-woven fabric. Evaluation results of the various properties thereof are shown in Table 2.

Comparative Example 4

A polyethylene terephthalate (PET) having an intrinsic viscosity of 0.65 dl/g was used to be melt-spun at a spinning temperature of 285° C. and a single-hole-jetting-out amount of 1.0 g/min. The resultant was subjected to fiber opening while pulled by means of an ejector. While the pulling rate was adjusted to make the arrangement of filaments thereof random on a net conveyer, the filaments were deposited thereon. This process gave a spunbonded non-woven fabric having a weight of 200 g/m$^2$ and made of a long fiber having a monofilament fineness of 2.0 dtex. Next, an embossing roll having a compression area proportion of 9%, in which convex portions each having a polygonal pyramid frustum shape were arranged in a staggered form, was used to emboss the non-woven fabric at 230° C. and a linear pressure of 20 kN/m to yield a thermocompression-bondable type filament non-woven fabric.

A knife coater was used to coat the front surface (embossed surface) of the thermocompression-bondable type filament non-woven fabric with the resin composition 1 so that a resin adhesion amount is 80 g/m$^2$ after the resin is dried. The resultant workpiece was then dried, and then a trapezoidal-grating-pattern type embossing roll was used to emboss the workpiece at 153° C. and a linear pressure of 70 kN/m to yield a resin-coated non-woven fabric. Evaluation results of the various properties thereof are shown in Table 2.

Comparative Example 5

A polyethylene terephthalate (PET) having an intrinsic viscosity of 0.65 dl/g was used to be melt-spun at a spinning temperature of 285° C. and a single-hole-jetting-out amount of 1.0 g/min. The resultant was subjected to fiber opening while pulled by means of an ejector. While the pulling rate was adjusted to make the arrangement of filaments thereof random on a net conveyer, the filaments were deposited thereon. This process gave a spunbonded non-woven fabric having a weight of 40 g/m$^2$ and made of a long fiber having a monofilament fineness of 2.0 dtex. Next, an embossing roll having a compression area proportion of 9%, in which convex portions each having a polygonal pyramid frustum shape were arranged in a staggered form, was used to emboss the non-woven fabric at 230° C. and a linear pressure of 20 kN/m to yield a thermocompression-bondable type filament non-woven fabric.

A knife coater was used to coat the front surface (embossed surface) of the thermocompression-bondable type filament non-woven fabric with the resin composition 1 so that a resin adhesion amount is 80 g/m$^2$ after the resin is dried. The resultant workpiece was then dried, and then a trapezoidal lattice type embossing roll was used to emboss the workpiece at 153° C. and a linear pressure of 70 kN/m to yield a resin-coated non-woven fabric. Evaluation results of the various properties thereof are shown in Table 2. In Comparative Example 5, the weight of the non-woven fabric was too small, so that plural holes were observed in the resin-coated non-woven fabric coated with the resin composition 1 and then embossed.

Comparative Example 6

A thermocompression-bondable type filament non-woven fabric was yielded in the same way as in Example 1.

A knife coater was used to coat the front surface (embossed surface) of the thermocompression-bondable type filament non-woven fabric with the resin composition 1 so that a resin adhesion amount is 200 g/m$^2$ after the resin is dried. The resultant workpiece was then dried, and then a trapezoidal-grating-pattern type embossing roll was used to emboss the workpiece at 153° C. and a linear pressure of 70 kN/m to yield a resin-coated non-woven fabric. Evaluation results of the various properties thereof are shown in Table 2.

Comparative Example 7

A thermocompression-bondable type filament non-woven fabric was yielded in the same way as in Example 1.

A knife coater was used to coat the front surface (embossed surface) of the thermocompression-bondable type filament non-woven fabric with the resin composition 1 so that a resin adhesion amount is 30 g/m$^2$ after the resin is dried. The resultant workpiece was then dried, and then a trapezoidal-grating-pattern type embossing roll was used to emboss the workpiece at 153° C. and a linear pressure of 70 kN/m to yield a resin-coated non-woven fabric. Evaluation results of the various properties thereof are shown in Table 2.

Comparative Example 8

A polyethylene terephthalate (PET) having an intrinsic viscosity of 0.65 dl/g was used to be melt-spun at a spinning temperature of 285° C. and a single-hole-jetting-out amount of 1.0 g/min. The resultant was subjected to fiber opening while pulled by means of an ejector. While the pulling rate was adjusted to make the arrangement of filaments thereof random on a net conveyer, the filaments were deposited thereon. This process gave a spunbonded non-woven fabric having a weight of 100 g/m$^2$ and made of a long fiber having a monofilament fineness of 2.0 dtex. Next, an embossing roll having a compression area proportion of 9%, in which convex portions each having a polygonal pyramid frustum shape were arranged in a staggered form, was used to emboss the non-woven fabric at 230° C. and a linear pressure of 20 kN/m. Further, a needle punching machine was used to entangle with needle punching at a needle count of 40, a needle density of 65 needles/cm$^2$, and a needle depth of 12 mm to yield a needle-punched filament non-woven fabric.

A knife coater was used to coat the front surface (embossed surface) of the needle-punched type filament non-woven fabric with the resin composition 1 so that a resin adhesion amount is 80 g/m$^2$ after the resin is dried. The resultant workpiece was then dried, and then a trapezoidal-grating-pattern type embossing roll was used to emboss the workpiece at 153° C. and a linear pressure of 70 kN/m to yield a resin-coated non-woven fabric. Evaluation results of the various properties thereof are shown in Table 2.

TABLE 1

| | | Example 1 | Example 2 | Example 3 | Example 4 | Example 5 | Example 6 | Example 7 | Example 8 |
|---|---|---|---|---|---|---|---|---|---|
| Spunbonded non-woven fabric | Weight (g/m$^2$) | 100 | 100 | 100 | 100 | 150 | 50 | 100 | 100 |
| | Type | Embossed | Embossed | Embossed | Embossed | Embossed | Embossed | Embossed | Embossed |
| Resin | Processing method | Coating | Coating | Coating | Coating | Coating | Coating | Coating | Coating |
| | Coated surface | Embossed surface | Embossed surface | Embossed surface | Embossed surface | Embossed surface | Embossed surface | Non-embossed surface | Embossed surface |
| | Adhesion amount (g/m$^2$) | 80 | 80 | 80 | 80 | 150 | 50 | 80 | 80 |
| | Tg (° C.) | 0 | −22 | −10 | 0 | 0 | 0 | 0 | 50 |
| | Content of acrylic acid ester unit (%) | 40 | 50 | 35 | 55 | 40 | 40 | 40 | 40 |
| | Content of vinyl chloride unit (%) | 24 | 15 | 35 | 16 | 24 | 24 | 24 | 24 |
| Product | Weight (g/m$^2$) | 180 | 180 | 180 | 180 | 300 | 100 | 180 | 180 |
| | Embossing pattern | Geometric | Geometric | Skin-grains | Skin-grains | Geometric | Geometric | Geometric | Geometric |
| Evaluation | Design property | ○ | ○ | ○ | ○ | ○ | ○ | ○ | Δ |
| | Curling | 13 | 12 | 10 | 10 | 15 | 18 | 25 | 10 |
| | Bending resistance (mm) | 115 | 108 | 131 | 110 | 128 | 85 | 105 | 159 |
| | Welder property | 6.5 | 6.3 | 7.2 | 5.7 | 7.1 | 5.8 | 6.4 | 5.5 |
| | Strength (N/cm) | 95 | 94 | 90 | 90 | 112 | 65 | 89 | 93 |

TABLE 2

| | | Comparative example 1 | Comparative example 2 | Comparative example 3 | Comparative example 4 | Comparative example 5 | Comparative example 6 | Comparative example 7 | Comparative example 8 |
|---|---|---|---|---|---|---|---|---|---|
| Spunbonded non-woven fabric | Weight (g/m$^2$) | 100 | 100 | 100 | 200 | 40 | 100 | 100 | 100 |
| | Type | Embossed | Embossed | Embossed | Embossed | Embossed | Embossed | Embossed | Needle-punched |
| Resin | Processing method | Coating | Coating | Coating | Coating | Coating | Coating | Coating | Coating |
| | Coated surface | Embossed surface | Embossed surface | Embossed surface | Embossed surface | Embossed surface | Embossed surface | Embossed surface | Embossed surface |
| | Adhesion amount (g/m$^2$) | 80 | 80 | 80 | 80 | 80 | 200 | 30 | 80 |
| | Tg (° C.) | 0 | −10 | 0 | 0 | 0 | 0 | 0 | 0 |
| | Content of acrylic acid ester unit (%) | 8 | 31 | 57 | 40 | 40 | 40 | 40 | 40 |
| | Content of vinyl chloride unit (%) | 32 | 49 | 8 | 24 | 24 | 24 | 24 | 24 |
| Product | Weight (g/m$^2$) | 180 | 180 | 180 | 280 | 120 | 300 | 130 | 180 |
| | Embossing pattern | Geometric | Geometric | Geometric | Geometric | Geometric | Geometric | Geometric | Geometric |
| Evaluation | Design property | x | Δ | ○ | ○ | Δ Hole | ○ | x | ○ |
| | Curling | 13 | 15 | 12 | 14 | 12 | 15 | 12 | 14 |
| | Bending resistance (mm) | 165 | 168 | 102 | 182 | 58 | 166 | 95 | 78 |
| | Welder property | 6.6 | 7.1 | 4.2 | 6.3 | 6.1 | 6.9 | 4.7 | 5.1 |
| | Strength (N/cm) | 96 | 95 | 91 | 128 | 35 | 115 | 52 | 53 |

INDUSTRIAL APPLICABILITY

The resin-coated non-woven fabric of the present invention is a flexible resin-coated non-woven fabric that may be welded through a high-frequency welder and may have a clear embossed pattern to be excellent in design property. Thus, the non-woven fabric is usable for a vehicle interior member such as a tonneau cover, wallpaper, a bed member, a chair member and others.

The invention claimed is:

1. A resin-coated non-woven fabric, which comprises a filament non-woven fabric that is of a thermocompression-bondable type, is made of a polyethylene terephthalate, and has a weight of 50 to 120 g/m$^2$, and a resin coat layer positioned over a surface of the filament non-woven fabric and having a coating amount of 40 to 150 g/m$^2$ after dried, wherein the resin coat layer contains 10 to 45% by mass of a vinyl chloride unit and 30 to 55% by mass of a (meth)acrylic acid ester unit, and a surface of the resin coat layer has an embossed pattern, wherein the resin-coated non-woven fabric has a strength of 65 N/cm or more when the fabric is broken by pulling at a pulling rate of 200 mm/min.

2. The resin-coated non-woven fabric of claim 1, wherein the resin coat layer has at least one glass transition temperature (Tg) of 30° C. or lower according to differential scanning calorimetry (DSC) of the layer.

3. The resin-coated non-woven fabric of claim 1, wherein the filament is not subjected to entangle with needle punching.

4. The resin-coated non-woven fabric of claim 1, wherein the filament non-woven fabric has an embossed surface and a non-embossed surface, the resin coat layer is positioned over the embossed surface, and the filament non-woven fabric has no resin coat layer on the non-embossed surface.

5. The resin-coated non-woven fabric of claim 1, wherein flexibility of the resin-coated non-woven fabric is from 80 to 160 mm, and tensile strength of a high-frequency welder welded portion of the resin-coated non-woven fabric is 5.0 N/cm or more.

6. The resin-coated non-woven fabric of claim 3, wherein flexibility of the resin-coated non-woven fabric is from 80 to 160 mm, and tensile strength of a high-frequency welder welded portion of the resin-coated non-woven fabric is 5.0 N/cm or more.

* * * * *